US007662439B2

(12) United States Patent
Särkilahti et al.

(10) Patent No.: US 7,662,439 B2
(45) Date of Patent: Feb. 16, 2010

(54) METHOD FOR FEEDING LIQUID TO A FLAME SPRAYING APPARATUS

(75) Inventors: Simo Särkilahti, Muijala (FI); Simo Tammela, Espoo (FI)

(73) Assignee: Liekki Oy, Lohja AS (FI)

( * ) Notice: Subject to any disclaimer, the term of this patent is extended or adjusted under 35 U.S.C. 154(b) by 765 days.

(21) Appl. No.: 10/544,933

(22) PCT Filed: Feb. 11, 2004

(86) PCT No.: PCT/FI2004/050012

§ 371 (c)(1),
(2), (4) Date: Aug. 10, 2005

(87) PCT Pub. No.: WO2004/071672

PCT Pub. Date: Aug. 26, 2004

(65) Prior Publication Data

US 2006/0172078 A1 Aug. 3, 2006

(30) Foreign Application Priority Data

Feb. 11, 2003 (FI) ..... 20030200

(51) Int. Cl.
*B05D 1/08* (2006.01)

(52) U.S. Cl. ..... 427/446; 427/163.23

(58) Field of Classification Search ..... 427/162, 427/446, 163.2; 118/300, 715
See application file for complete search history.

(56) References Cited

U.S. PATENT DOCUMENTS

| | | | | |
|---|---|---|---|---|
| 3,501,097 | A | 3/1970 | Daley | |
| 4,391,860 | A | 7/1983 | Rotolico et al. | |
| 4,500,038 | A | 2/1985 | DeFerrari et al. | |
| 4,540,120 | A | 9/1985 | Waszkiewicz | |
| 5,803,360 | A * | 9/1998 | Spitznagel | 239/345 |
| 7,083,332 | B2 * | 8/2006 | Mukouda | 385/71 |
| 7,112,758 | B2 * | 9/2006 | Ma et al. | 219/121.47 |

FOREIGN PATENT DOCUMENTS

| | | |
|---|---|---|
| EP | 0058571 A1 | 8/1982 |

* cited by examiner

*Primary Examiner*—Timothy H Meeks
*Assistant Examiner*—Elizabeth Burkhart
(74) *Attorney, Agent, or Firm*—Venable LLP; Eric J. Franklin

(57) ABSTRACT

A method and a liquid feeding device for feeding liquid in a flame spraying apparatus that is arranged for treating an optical fiber structure, as well as a flame spraying apparatus in which liquid feeding is arranged according to the invention. Liquid is supplied to an unpressurized space in a pressure generating part substantially in a constant flow. In the pressure generating part the pressure of liquid is generated by means of gravity influencing the liquid, and the pressurized liquid is arranged to be supplied to the flame spraying at a substantially constant pressure and at a constant flow rate.

2 Claims, 4 Drawing Sheets

METHOD FOR FEEDING LIQUID TO A FLAME SPRAYING APPARATUS

FIELD OF THE INVENTION

Figure 1:
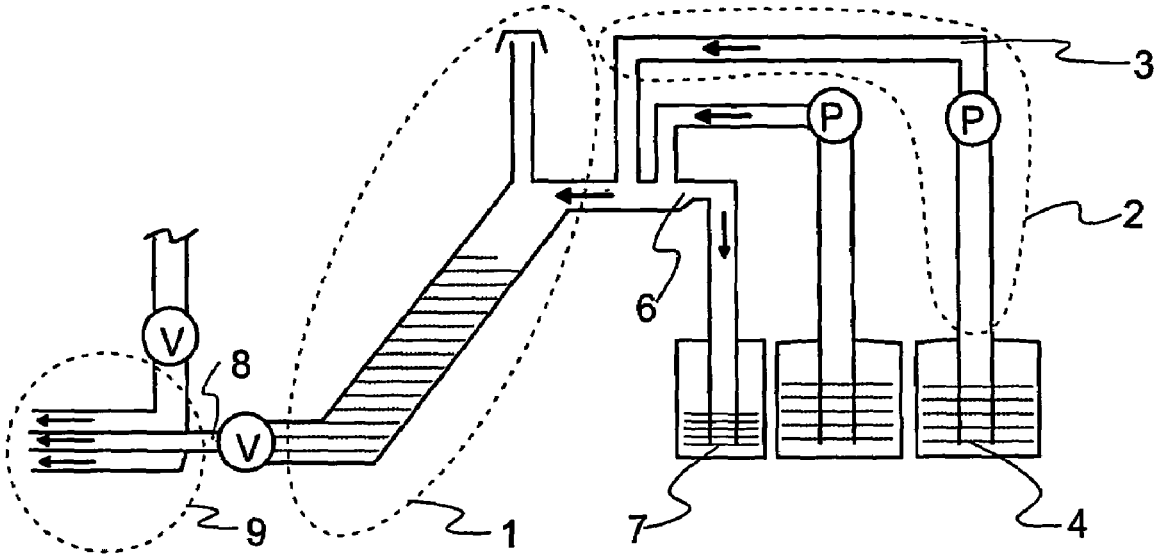

The invention relates to a method for feeding liquid in flame spraying. The invention also relates to a liquid feeding device, as well as to a flame spraying apparatus.

BACKGROUND OF THE INVENTION

In the flame spraying process utilized for producing and coating optical structures a flame is directed to the target that is being treated, and a desired material or additive is fed to said flame typically in liquid format. Said material meets the target to be treated typically in particle format, steam or gas. When the material comes into contact with the target to be treated, the properties of the target can be changed. For example the properties, such as colour, of the surface layer of an optical fibre structure, such as a fibre preform or optical fibre, can be changed by means of flame spraying.

Typically a flame spraying apparatus comprises at least one nozzle by means of which a flame is directed to the target to be treated. Conventionally the nozzle comprises several channels that are positioned co-axially. Different components are introduced to the flame through different channels, wherein different material are brought in contact with each other only after the opening of the nozzle. In an embodiment of flame spraying a liquid material is supplied via the innermost channel of the nozzle, and fuel gas, such as hydrogen, is supplied via a ring-like channel surrounding said channel. The flow of hydrogen generates an ejector phenomenon, which, in turn, brings about the absorption of liquid out of the channel, and spraying of said liquid to the gas flow.

The feeding of liquid utilized in flame spraying must be accurate and it must endure back-pressure. In known solutions the pressure of the supplied liquid is generated by means of a pump or it is based on height difference. In piston-type solutions yielding of the feeder as well as leakage resulting therefrom have been detected when high pressures have been used, which have occurred for example when liquid has been pumped through capillaries. Furthermore, as a result of pumping, fluctuation of the pressure level of the liquid often takes place. The throttling of the liquid flow may also cause problems when the possibility of cavitation in the liquid flow increases.

In solutions based on the height difference the aim has been to standardize the pressure by keeping the liquid level at constant height. Therefore in known solutions the location of the container containing liquid is adjusted in the height direction in such a manner that when the liquid content in the container is reduced, the container is moved upwards. Typically, the amount of liquid contained in the container has been estimated on the basis of weight. Such an apparatus is, however, relatively complex in structure, and it is especially difficult to determine the weight of the container containing liquid in real time.

SUMMARY OF THE INVENTION

It is a primary purpose of the present invention to introduce a liquid feeding device by means of which it is possible to attain an accurately determined pressure in the liquid fed to the flame spraying device, as well as a substantially constant flow in a simple and reliable manner.

To attain this purpose, the present invention provides a method, a liquid feeding device, and a flame spraying apparatus.

The basic idea of the invention is to supply the liquid used in flame spraying in a flow of substantially constant magnitude into a space in which prevails the air pressure that surrounds the device, i.e. said space is unpressurized. Via said space the liquid is transferred to the structure, in which the inflow plane is located on substantially higher level than the outflow plane. By means of said structure is it possible to utilize earth's gravity to attain such a pressure in the liquid that is proportional to the density of the liquid and to the height difference of the liquid pillar. Thus, a constant pressure level in which fluctuation does not occur is produced in the liquid conveyed to flame spraying, wherein the flow produced in the tubular capillary liquid channel in the flame spraying apparatus advantageously remains constant and the spraying result of flame spraying is as uniform as possible.

The liquid feeding device according to the basic idea of the invention is constructed in such a manner that it comprises at least a dosing part and a pressure generating part connected thereto. The dosing part is connected to the pressure generating part in such a manner that the pressure generated in the pressure generating part is not exerted to said dosing part. Within a long period of time the dosing part generates a substantially accurate volume flow in the pressure generating part, said volume flow being substantially equal to the liquid flow produced by the liquid feeding device in the flame spraying apparatus. In the structure according to the invention the pressure generating part has the shape of a rather high container, such as a tubular container, in which pressure is generated by the height difference between the original liquid level and the upper liquid level. In the pressure generating part the pressure is generated in the liquid substantially by means of gravitational force, wherein the use of external force in the generation of pressure can be reduced.

Furthermore, the liquid remains in the pressure generating part according to the invention for some time before it is conveyed to the flame spraying, wherein the composition of the liquid blends and becomes balanced, which is especially advantageous when a number of different kinds of liquids are fed into the pressure generating part. The gas bubbles possibly occurring in the liquid are also removed from the liquid during the dwelling in the pressure generating part. It is advantageous that the state of the liquid is such that there are no gas bubbles therein when the liquid enters the flame spraying device, because in this way it is possible to attain as steady spraying as possible.

In the liquid feeding device according to the invention the dosing part is subjected to a substantially smaller pressure when compared to the pressure of the liquid fed by the liquid feeding device. This has a very advantageous effect on the durability and feasibility of the dosing part.

In one embodiment of the invention the pressure generating part advantageously functions also as a balancing unit for the liquid flow. Thus, the dosing part supplies liquid to the pressure generating part within a long period of time in a steady volume flow, although said volume flow of the liquid supplied by the dosing unit can momentarily vary to a certain extent. By means of a suitable implementation and design of the pressure generating part it is, however, possible to produce a substantially constant pressure in the liquid despite of the short-term variations in the volume flow caused by the dosing part.

It is also an advantage of an embodiment of the invention that a change in the temperature of the environment and/or liquid does not substantially affect the function of the liquid feeding device.

It has been observed that the liquid feeding device according to the invention functions well when liquid is supplied approximately 4 to 10 ml/min in the nozzle of the flame spraying device, in which the diameter of the liquid channel is under 1 mm. The invention is not, however, restricted to the amount of liquid to be supplied, or to the diameter of the liquid channel of the nozzle.

BRIEF DESRIPTION OF THE DRAWINGS

Figure 2:
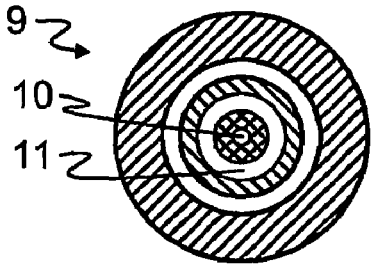
Figure 3:
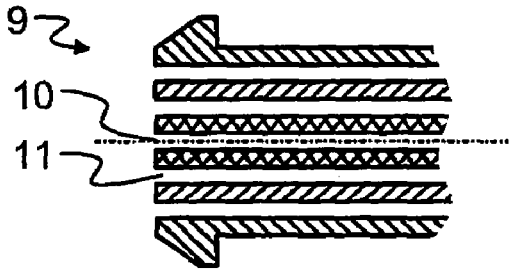

In the following, the invention will be described in more detail with reference to the appended principle drawings, in which FIG. 1 shows an embodiment of the liquid feeding device according to the invention, FIG. 2 shows a cross-section of one embodiment of a nozzle of the flame spraying device when seen in a direction parallel to the flow direction, FIG. 3 shows the cross-section of the nozzle of FIG. 2 in a side view and FIGS. 4 to 9 show other embodiments of the liquid feeding device according to the invention.

DETAILED DESCRIPTION OF EMBODIMENTS OF THE INVENTION

In the figures the examples are shown in a simplified manner, and they are not, for example, drawn to scale when compared with the actual embodiment. Furthermore, the figures primarily show only such details which are essential for understanding the invention. Other details are left out of the figures for the sake of clarity.

FIG. 1 shows an embodiment of the liquid feeding device according to the invention. The liquid feeding device according to said example comprises at least a pressure generating part 1 and a dosing part 2.

The function of the dosing part 2 is to feed liquid to the pressure generating part in such a manner that the pressure in the pressure generating part remains substantially constant. The dosing part 2 comprises at least a channel 3 for feeding liquid and a pump member P for moving the liquid. It is possible to use any suitable pump type, such as a hose pump, a film pump or a piston pump as the pump member P.

There are typically one to three dosing parts 2 per one pressure generating part 1. The number of the dosing parts 2 is affected by the number of materials to be fed to the pressure generating part 1. It is also possible that there are a larger number of dosing parts 2 than said three units. The example shows two liquid containers 4 from which the liquids are pumped to the pressure generating part 1. The Figure does not show the structures located in connection with the liquid containers 4 that are intended for supply of replacement air, such as valves equipped with filters.

In the example the pressure generating part 1 has a tubular shape and it is positioned in such a manner that its first end is located on a higher level than the second end. The upper end of the pressure generating part 1 is arranged in connection with the surrounding space, typically by means of filters, wherein for example the air pressure of the surrounding space functions as a starting level for the pressure of the pressure generating part. Advantageously, the pressure generating part is positioned in an angle of 40 to 70°, but naturally it can also arranged in another position. Similarly, the pressure generating part 1 can be formed in many different ways, as presented for example in FIGS. 8 and 9, wherein the properties of the liquid feeding device can be adjusted so that they comply well both with the entire process and the properties of the dosing part 2.

Typically, the inner diameter of the pressure generating part 1 is approximately 5 to 10 mm, and its height is approximately 1 to 1.5 meters, but the suitable diameter and height is selected according to the use. The height of the pressure generating part 1 is mainly affected by the desired pressure level of the liquid. By means of a small diameter it is possible to attain a small volume for the pressure generating part 1, wherein a large amount of liquid is not required for generating the pressure. By means of a larger diameter of the pressure generating part, a larger volume is attained for the pressure generating part, wherein the liquid feeding device is better suitable for such uses in which large liquid flows are required. In a preferred embodiment, the pressure generating part 1 is designed in such a manner that the diameter of its lower part is smaller and the upper part has a larger diameter, such as for example in the embodiments of FIGS. 8 and 9. Thus, the pressure is generated with a relatively small amount of liquid. Furthermore, said large upper part makes- it possible to use a dosing part 2 that generates a more irregular liquid flow, because the extension of the pressure generating part 1 balances the surface variation produced by the irregularly supplied liquid, and thus substantially standardizes the pressure as well.

It is advantageous that the pressure of the liquid is constant without rapid changes in the pressure value because of the nozzle structure 9 used in the flame spraying apparatus. One principle view of a typical nozzle 9 is shown in FIGS. 2 and 3. The nozzle is composed of two or several tubular channels 10, 11, which are placed within each other in a substantially coaxial manner. The number of the channels 10, 11 depends on the number of different materials used in the flame spraying, the number of the materials in use being typically two to five (gas or liquid). It has been observed that the liquid feeding device according to the invention functions well for example when liquid is fed 4 to 10 ml/min via the innermost channel 10 of the nozzle 9 whose diameter is under 1 mm. Thus, the substantially constant pressure generated in the liquid by the liquid feeding device enables the capillary function of the channel, wherein the liquid ends up in the end of the channel 10 on the side of the flame spraying in a substantially steady volume flow. From said end of the channel 10 the liquid is absorbed from the outer channel 11 surrounding said innermost channel 10 towards the target to be treated as a result of the supplied strong material flow. The fuel gas, such as hydrogen that is used in the process is typically fed from the outer channel 11. As a result of the ejector-phenomena generated inside the gas flow, the material to be supplied is "absorbed" and distributed evenly in the flow, and it reaches high speed before meeting the target. The invention is not dependent on the type of the nozzle 9 in use, or on that from which channel 10, 11 of the nozzle each material is fed.

It is possible to implement the determination of pressure generated in the liquid in the pressure generating part 1 in many different ways according to the spirit of the present invention. One way is to arrange the outlet port 8 connecting the pressure generating part 1 to the process in such a manner that the liquid flow provided by the same is substantially equal to the liquid flow produced by the dosing part 2 within a longer period of time. Thus, before the process is activated, for example before the flame spraying, the pressure generating part 1 is provided with such an amount of liquid that the height of the liquid pillar produced by the same corresponds to the desired pressure. In a preferred embodiment the temporary increase in the liquid level that takes place in the pressure generating part 1 brings about an increase in the pressure in the outlet port as well as an increase in the liquid flow. As a result of this the liquid level and thus also the pressure level return to the determined level. Such a solution is simple and gives a sufficient accuracy for various uses, especially when the densities of the liquid or liquids in use do not vary significantly.

Figure 4:
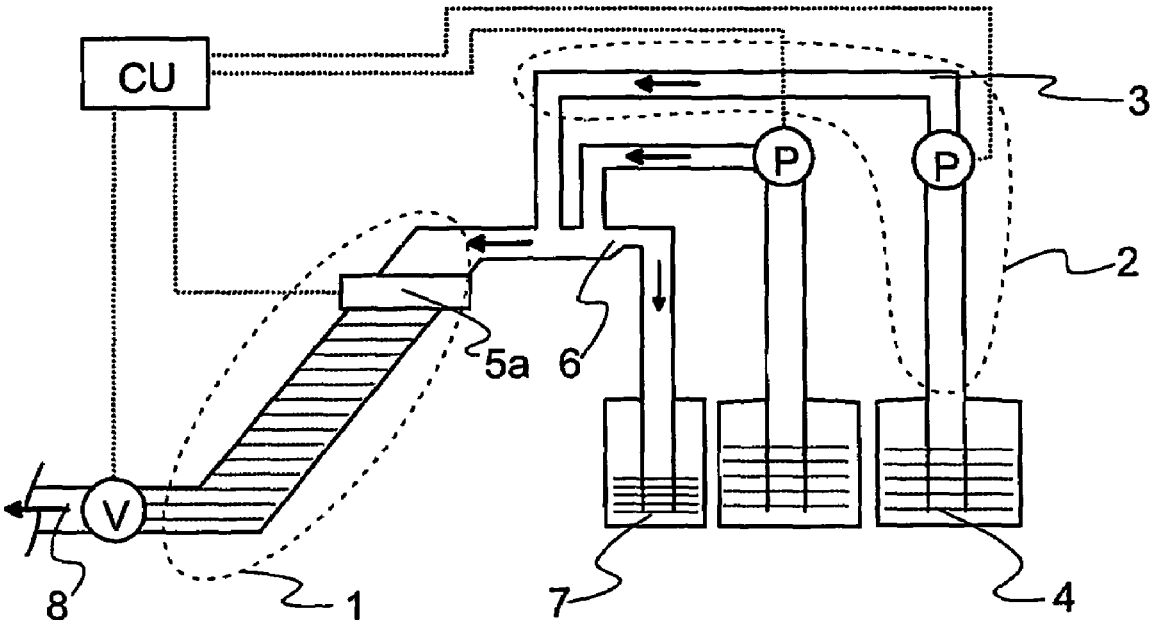

According to FIG. 4, another way of determining the pressure is to determine the height of the liquid level, in which it is possible to utilize various known solutions, such as for example optical 5a or electric sensors. Such a solution is relatively simple and sufficiently accurate for various uses, especially when the densities of the liquid or liquids in use do not vary. Furthermore, said arrangement is advantageously also suitable for monitoring the liquid level. If the density of the liquid varies, it is advantageous to determine the density of the liquid, which can be implemented for example in connection with the dosing part 2. One way is to measure the mass of the liquid container 4, wherein when the volume flow produced by the pump P is known, it is possible to determine the density of the liquid. Thereafter it is possible to determine the pressure on the basis of the density of the liquid and the liquid level, and by controlling the liquid flow of the dosing part 2 it is possible to influence the liquid level as well as the pressure.

Figure 5:
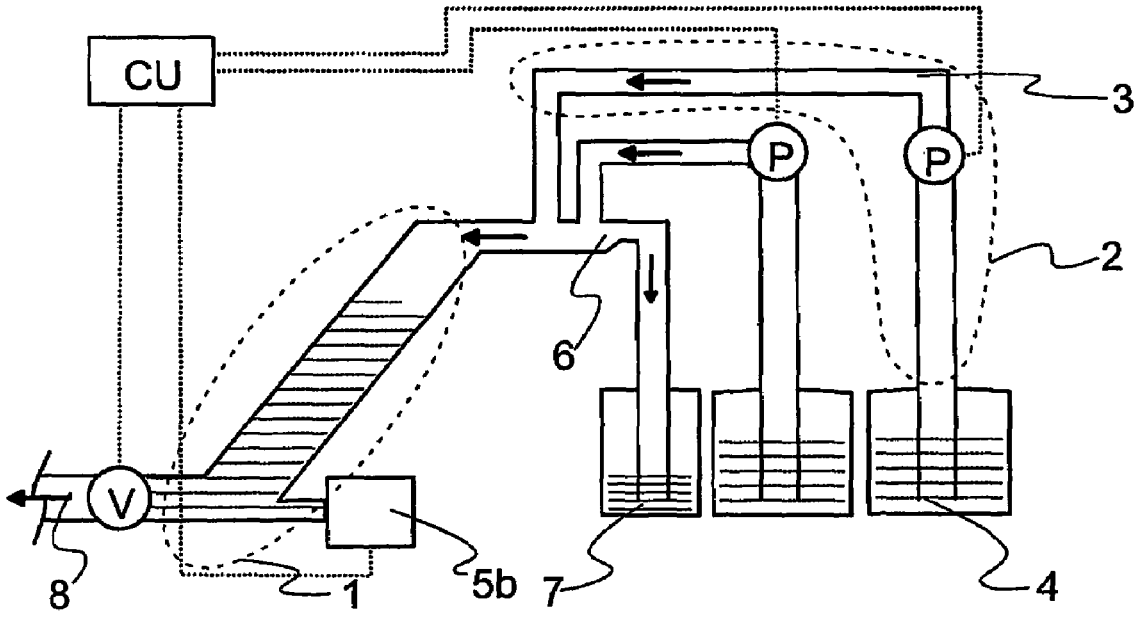

FIG. 5 show a third advantageous way of determining the pressure of the liquid in the pressure generating part 1 by means of a pressure sensor 5*b* (or pressure meter), said pressure sensor being connected to the lower part of the pressure generating part. On the basis of the information obtained from the pressure sensor 5*b* it is possible to adjust the liquid flow of the dosing part 2 or dosing parts to reduce or increase said flow.

From the pressure generating part 1 the liquid is fed to further processing, i.e. typically to a flame spraying apparatus in which the pressurized liquid is sprayed through the nozzle 9 towards the material to be processed. The travel of the liquid away from the pressure generating part 1 is adjusted with a closing means V, such as a valve, which is advantageously arranged such that is can be closed entirely.

If necessary, the control CU of the device can be implemented in various ways, and the actual control unit can also be positioned in various different locations. Typically the control CU can be arranged in connection with the control unit of the rest of the flame spraying apparatus, but the control can also be arranged in connection with the sensor 5*a*, 5*b*, or the pump P, or the control can be implemented with a separate unit. It is a principle of the liquid feeding device according to the invention that such an amount of liquid is fed to the pressure generating part 1 that substantially corresponds to the amount of liquid fed to the flame spraying apparatus. Thus, the pressure generating part 1 generates a substantially constant pressure in the liquid to be supplied. Because variations may occur in the flow of the valve V and in the operation of the dosing parts 2 as well as in the liquid flows produced by the same, it is advantageous to utilize also other arrangements for monitoring the pressure, said arrangements providing control and/or monitoring data for the control unit CU. Said other arrangements include for example the means 5*a* and pressure sensors 5*b* for monitoring the liquid level that are disclosed in the examples.

Furthermore, the apparatus is typically equipped with structures such as overflow channels 6 and overflow containers 7 illustrated in the Figures. By means of said structures the liquid flow can also be controlled in possible problem and interference situations. Advantageously, the overflow container 7 is dimensioned in such a manner that there is enough room therein for the liquid contained in the liquid container 4 or liquid containers. Furthermore, the apparatus typically comprises such structures that are not shown in the Figures, such as the above-mentioned structures for supplying replacement air and gas removal valves, as well as possible sensors used for monitoring liquid levels.

Figure 6:
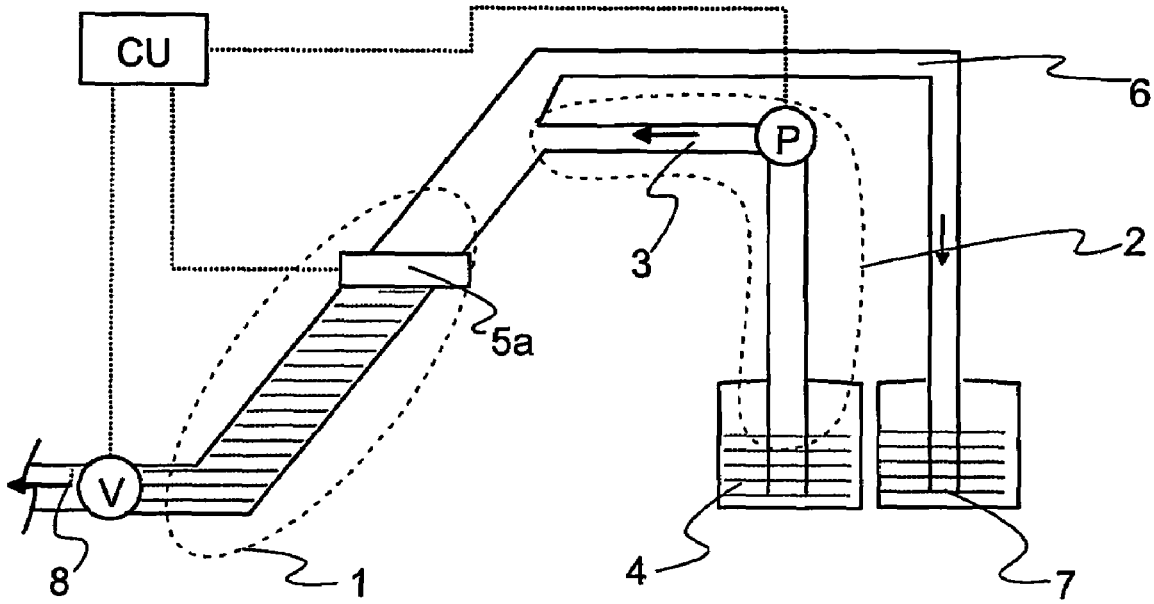

FIG. 6 shows yet another embodiment for implementing the liquid feeding device according to the invention. As can be seen in said example, it is possible to change for example the mutual placement of different liquid channels 3, 6 by maintaining the basic idea of the invention.

Figure 7:
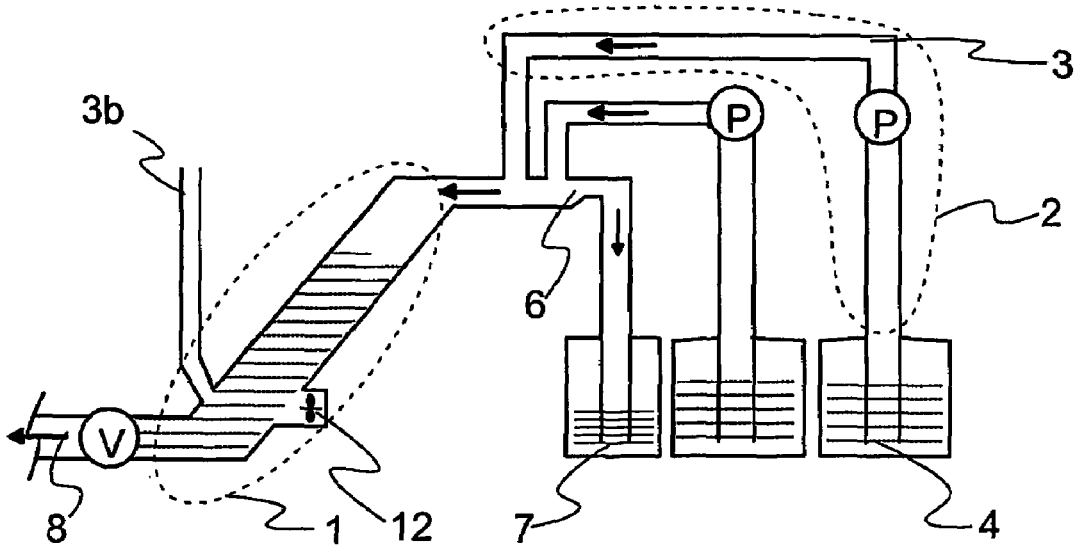
Figure 8:
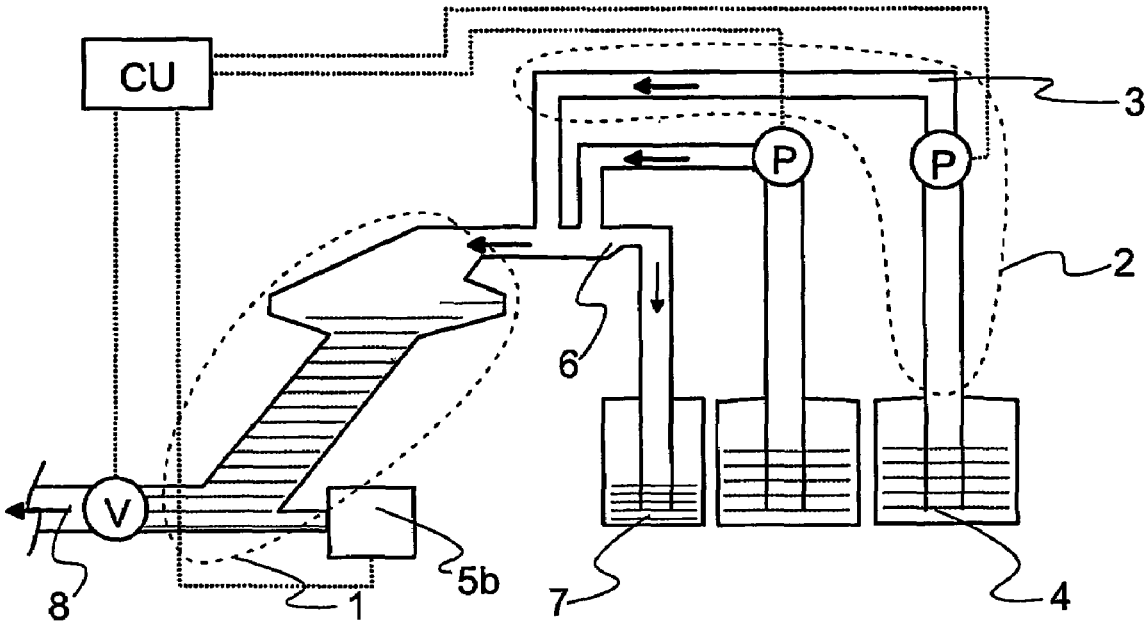
Figure 9:
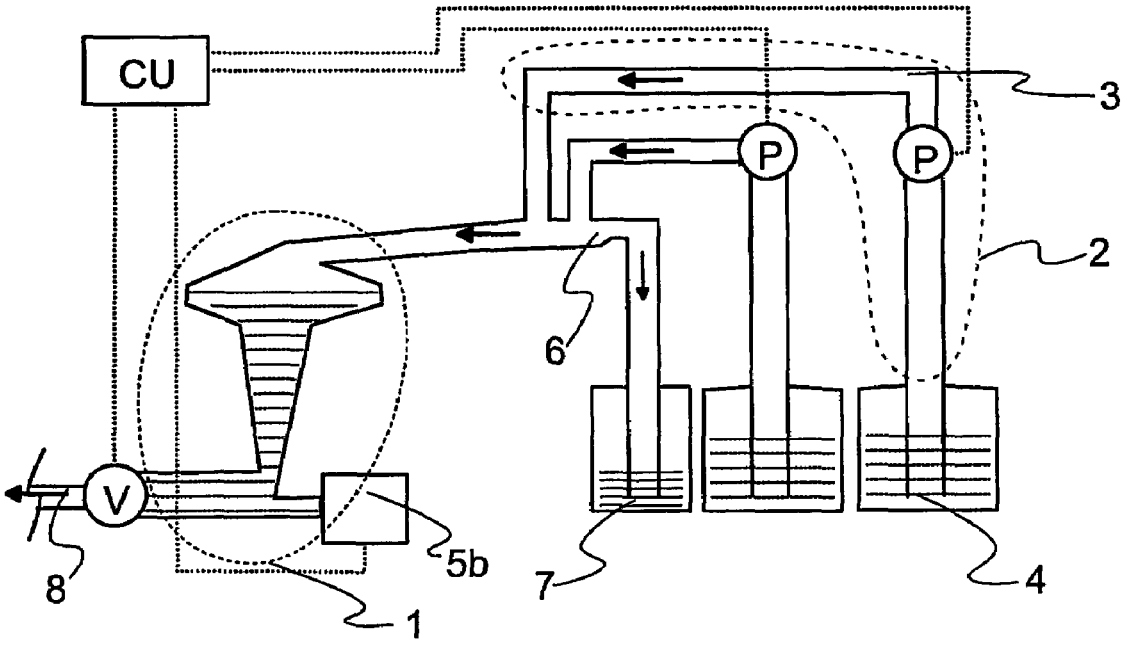

FIG. 7 shows yet another embodiment for implementing the liquid feeding device according to the invention. As can be seen in said example, it is also possible to arrange the liquid feeding channel 3*b* close to the original level of liquid. Thus, it is advantageous to provide the structure with a suitable mixing member 12 as well, said mixing member being utilized for enhancing the mixing of different liquids. Said embodiment is preferably used for adding such additives whose proportion in the total amount of liquid in use is small, and the proportioning of which is desired to be arranged so that it reacts to the control as well as possible.

It is, of course, obvious that the invention is not restricted solely to the embodiment disclosed in the example above, but for example in the liquid feeding device according to the invention it is possible to design the pressure generating part 1 in many different ways, and the placement of the different channels 3, 6 can be implemented in various different ways.

Furthermore, the invention is not restricted to the structure of the nozzle 9 used in the flame spraying apparatus or to the number of the liquid feeding devices. There may be only one or several liquid feeding devices according to the invention per one flame spraying apparatus, for example one for each nozzle 9of the flame spraying apparatus.

By combining, in various ways, the modes and structures disclosed in connection with the different embodiments of the invention presented above, it is possible to produce various embodiments of the invention in accordance with the spirit of the invention. Therefore, the above-presented examples must not be interpreted as restrictive to the invention, but the embodiments of the invention can be freely varied within the scope of the inventive features presented in the claims hereinbelow.

The invention claimed is:

1. A method for feeding liquid in a flame spraying apparatus arranged for treating an optical fiber structure, the method comprising:

feeding liquid to an unpressurized space substantially in a constant flow to maintain a substantially constant level of the liquid in the unpressurized space, generating pressure in the liquid by gravity influencing the liquid, and arranging the liquid to be fed to the flame spraying at a substantially constant pressure and at a constant flow rate.

2. The method according to claim 1, wherein the pressure of the liquid is generated in such a manner that the liquid is fed to a pressure generating part generating the pressure from a first plane, and removed from said pressure generating part from a second plane that is positioned below the first plane.

* * * * *

UNITED STATES PATENT AND TRADEMARK OFFICE

CERTIFICATE OF CORRECTION

PATENT NO. : 7,662,439 B2
APPLICATION NO. : 10/544933
DATED : February 16, 2010
INVENTOR(S) : Särkilahti et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1179 days.

Signed and Sealed this

Thirtieth Day of November, 2010

David J. Kappos

David J. Kappos
*Director of the United States Patent and Trademark Office*